US006328170B1

(12) United States Patent
Lee

(10) Patent No.: US 6,328,170 B1
(45) Date of Patent: Dec. 11, 2001

(54) GRAVITY FEED SHELF

(75) Inventor: Jin Geong Lee, Seoul (KR)

(73) Assignee: Daewoo Electronics Co., Ltd., Seoul (KR)

( * ) Notice: Subject to any disclaimer, the term of this patent is extended or adjusted under 35 U.S.C. 154(b) by 0 days.

(21) Appl. No.: 09/514,336

(22) Filed: Feb. 28, 2000

(30) Foreign Application Priority Data

Oct. 20, 1999 (KR) ..... 99-45503
Oct. 20, 1999 (KR) ..... 99-45504
Oct. 20, 1999 (KR) ..... 99-45505

(51) Int. Cl.[7] ..... A47F 1/04

(52) U.S. Cl. ..... 211/59.2; 211/49.1; 211/181.1; 211/153; 211/74

(58) Field of Search ..... 211/59.2, 59.4, 211/181.1, 49.1, 74, 134–135, 153, 126.6, 184, 126.1, 183, 149, 133.5; 108/108, 60–61, 57.29, 57.16, 57.17, 57.33, 67, 157.15, 158.12; 206/561, 486, 562, 564, 557, 587

(56) References Cited

U.S. PATENT DOCUMENTS 2,218,444 * 10/1940 Vineyard .
3,161,296 * 12/1964 Sartor .
3,545,624 * 12/1970 Krikorian ..... 211/126.1
3,780,873 * 12/1973 Silva ..... 211/49.1
3,998,069 * 12/1976 Kronenberger et al. ..... 211/126.1
4,128,177 * 12/1978 Bustos ..... 211/49.1
4,138,015 * 2/1979 Rabley ..... 206/561
4,416,380 * 11/1983 Flum ..... 211/49.1
4,461,388 * 7/1984 Bustos ..... 211/49.1
4,685,574 * 8/1987 Young et al. ..... 211/59.2
4,757,769 * 7/1988 Suttles ..... 108/111
4,801,025 * 1/1989 Flum et al. ..... 211/59.2
4,890,746 * 1/1990 Trulaske, Sr. ..... 211/59.2
4,901,869 * 2/1990 Hawkinson et al. ..... 211/59.3
4,927,022 * 5/1990 Wilson ..... 206/443
4,955,486 * 9/1990 Trulaske, Sr. ..... 211/59.2
5,076,443 12/1991 Trulaske, Sr. .
5,199,584 * 4/1993 Fowler et al. ..... 211/59.2
5,240,124 * 8/1993 Buday ..... 211/59.2
5,645,176 * 7/1997 Jay ..... 211/59.2
6,010,016 * 1/2000 Siegal ..... 211/126.1
6,135,297 * 10/2000 DeShazo et al. ..... 211/74

* cited by examiner

*Primary Examiner*—Daniel P. Stodola
*Assistant Examiner*—Jennifer E. Novosad
(74) *Attorney, Agent, or Firm*—Pennie & Edmonds LLP

(57) ABSTRACT

A gravity feed shelf capable of allowing a distance between a plurality of guide rails to be easily adjusted includes an upper shelf member having a pair of side frames, a pair of cross bars fixed on an upper portion of the side frames, respectively, a pair of junction bars fixed on a lower portion of the side frames, and a pair of guide fixing members, each being disposed on the cross bar. The guide fixing members are used to easily adjust the distance between the guide rails, thereby expanding the range of containers to be store therein. Further, the gravity feed shelf includes a lower shelf member having a pair of U-shaped channels and a plurality of plane members. Each of the plane members has a first surface with a plurality of projections with a relatively low contact area and a second surface with a plurality of projections with a relatively large contact area, the first or the second surfaces being selectively utilized depending on the weight of the containers to be stored.

7 Claims, 7 Drawing Sheets

GRAVITY FEED SHELF

FIELD OF THE INVENTION

The present invention relates to a gravity feed shelf for use in a display stand or in a refrigerator unit; and, more particularly, to a gravity feed shelf, capable of allowing a distance between a plurality of guide rails to be easily adjusted.

DESCRIPTION OF THE PRIOR ART

There is shown in FIG. 1 a typical gravity feed shelving system disclosed in U.S. Pat. No. 5,076,443, including a shelf supporting member 10, a plurality of lower shelf members 20 and an upper shelf member 30.

The shelf supporting member 10 includes a rectangular frame 12 having a pair of horizontal intermediate bars 15 and a plurality of longitudinal supporting rails 14 fixed on the frame 12 by welding. The frame 12 is supported by a suspension(not shown) fixed on an inner rear surface of a showcase and inner hangers(not shown) formed on inner lateral surfaces thereof. One of the longitudinal supporting rails 14 is placed adjacent and parallel to each of the longitudinal sides of the frame 12, respectively, and three sets of three longitudinal supporting rails 14 are positioned therebetween with a predetermined space between the single rail and each set of the rails.

On the other hand, each of the lower shelf member 20 includes a plurality of overlays 22 having a pair of longitudinal fingers 24 and thin longitudinal ribs 26 formed on an upper surface of the overlay 22 so as to reduce a friction between containers and the overlay 22, respectively. The longitudinal fingers 24 are spaced apart to be closely adjacent to or engage the outer sides of rails 14, permitting a snap fit between the overlay 22 and the shelf supporting member 10.

Further, the upper shelf member 30 includes a plurality of guide rails 32 for preventing containers from falling through the sides of the shelf, a pair of cross bars 34 for preventing the containers from falling off the shelf, and a pair of junction bars 36 for fixing the guide rails 32 on the shelf supporting member 10. Accordingly, in the above conventional gravity feed shelving system, the lower shelf member 20 for supporting the containers is installed so as to incline from back to front. The guide rails 32 are used so that the containers placed on the lower shelf member 20 are arranged in rows and feed forward, by gravity, when the frontmost container in the row is removed. The cross bar 34 extending across the front of the lower shelf member 20 keeps the containers from falling off.

However, in such a prior art gravity feed shelving system, as a result of the guide rails 32 being fixed to the shelf supporting member 10, the cross bar 34 and the junction bar 36, the width between the guide rails 32 cannot be adjusted, thereby preventing the system from efficiently accommodating the containers having different diameters.

Further, in order for the refrigerator unit or display stand to accommodate the system, it must be provided with inner hangers on lateral surfaces on a plane inclined from back to front and a suspension on an rear surface thereof, thereby limiting the use of the system.

In addition, in order for the system to function properly, the size of the longitudinal ribs 26 formed on an upper surface of the overlay 22 must be properly matched with the height of the containers. If the thin longitudinal ribs 26 are too wide relative to the weight of the containers, the containers cannot slide smoothly as a result of the friction therebetween, whereas when too narrow, the containers too slide quickly, causing the containers to collide with each other or with the front cross bar 34.

SUMMARY OF THE INVENTION

Accordingly, it is an object of the invention to provide a gravity feed shelf which is capable of allowing a distance between a plurality of guide rails to be easily adjusted.

It is another object of the invention to provide a gravity feed shelf which is designed to be accommodated into a refrigerator unit or a display stand provided with horizontal inner hangers.

It is a still another object of the invention to provide a gravity feed shelf capable of allowing a sliding surface of the containers to be adjusted depending on the weight of the containers to be stored.

In accordance with an aspect of the present invention there is provided with a gravity feed shelf for use in a refrigerator unit or a display stand, said gravity feed shelf comprising:

a shelf supporting member including a rectangular frame and a plurality of longitudinal supporting rails;

a plurality of lower shelf members including a plurality of overlays having a pair of longitudinal fingers and thin longitudinal ribs formed on an upper surface of the overlays so as to reduce a friction between containers and the overlays, respectively; and an upper shelf member including a plurality of guide rails for preventing the containers from falling through both sides of the shelf, a pair of side frames, a pair of cross bars fixed on an upper portion of the side frames, respectively, for preventing the containers from falling off the shelf, a pair of junction bars fixed on a lower portion of the side frames for fixing the guide rails on the shelf supporting member, and a pair of guide fixing members, each being disposed on the cross bars.

In accordance with another aspect of the present invention, there is provided with a gravity feed shelf for use in a refrigerator unit or a display stand, said gravity feed shelf comprising:

a shelf supporting member including a rectangular frame, a pair of fixing members, and a plurality of longitudinal supporting rails;

a plurality of lower shelf members including a plurality of overlays having a pair of longitudinal fingers and thin longitudinal ribs formed on an upper surface of the overlays so as to reduce a friction between containers and the overlays, respectively; and an upper shelf member including a plurality of guide rails for preventing the containers from falling through both sides of the shelf, a pair of cross bars for preventing the containers from falling off the shelf, and a pair of junction bars for fixing the guide rails on the shelf supporting member.

In accordance with a still another aspect of the present invention, there is provided with a gravity feed shelf for use in a refrigerator unit or a display stand, said gravity feed shelf comprising:

a shelf supporting member including a rectangular frame, a pair of fixing members, each being mounted on a front portion and a rear portion of the frame, and a plurality of longitudinal supporting rails insertably fixed on the fixing members;

a lower shelf member including a pair of U-shaped channels having a laterally opened groove and a plurality of plane members having a first surface with a plurality of projections with a relatively low contact area and a second surface with a plurality of projections with a relatively large contact area; and an upper shelf member including a plurality of guide rails for preventing containers from falling through both sides of the shelf, a pair of cross bars for preventing the containers from falling off the shelf, and a pair of junction bars for fixing the guide rails on the shelf supporting member.

BRIEF DESCRIPTION OF THE DRAWINGS

The above and other objects, features and advantages of the present invention will become apparent from the following detailed description given in conjunction with the accompanying drawings, in which.

DETAILED DESCRIPTION OF THE PREFERRED EMBODIMENTS

Figure 1:
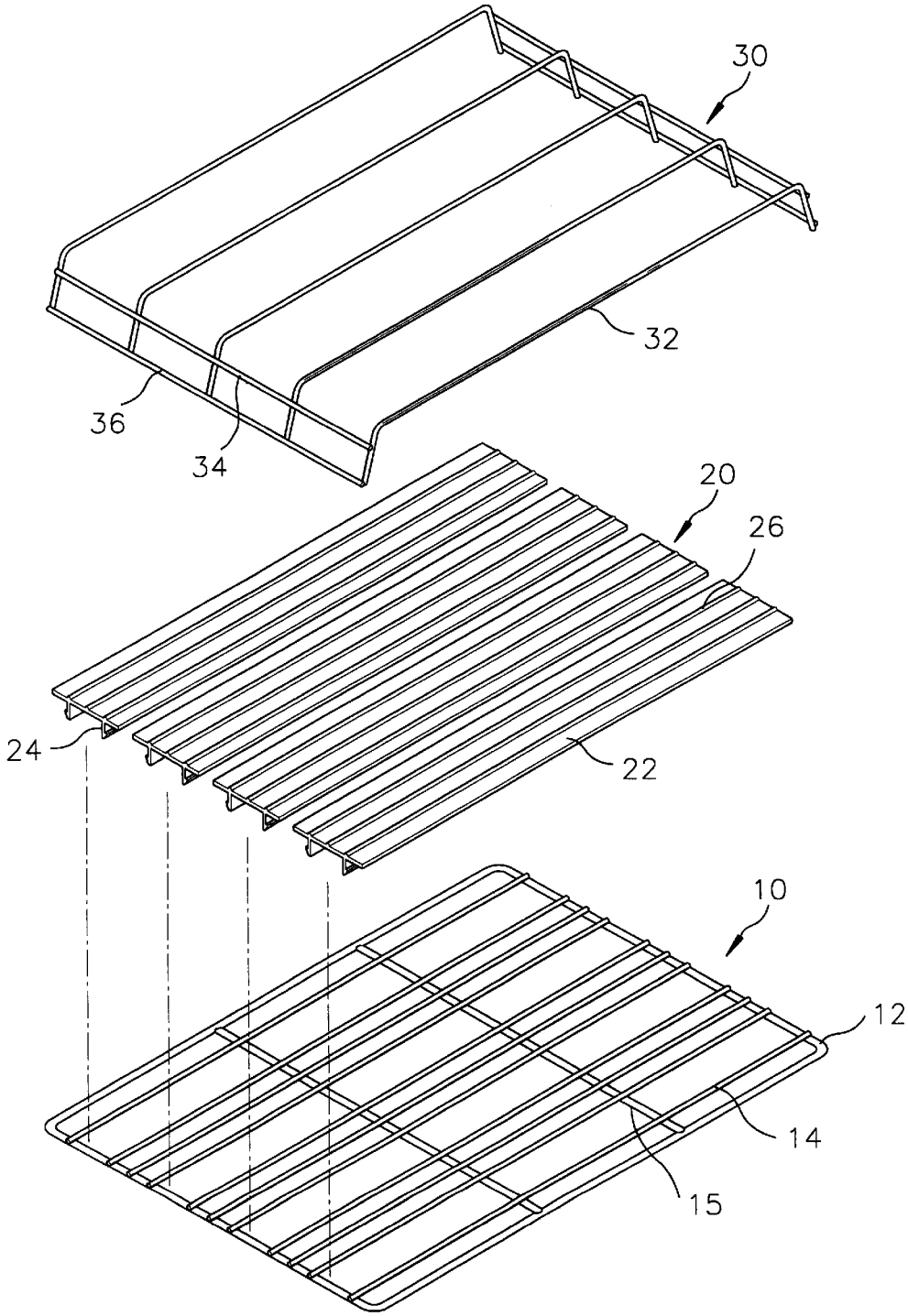
FIG. 1 (PRIOR ART)
FIG. 1 shows an exploded perspective view of a conventional gravity feed shelf.
Figure 2:
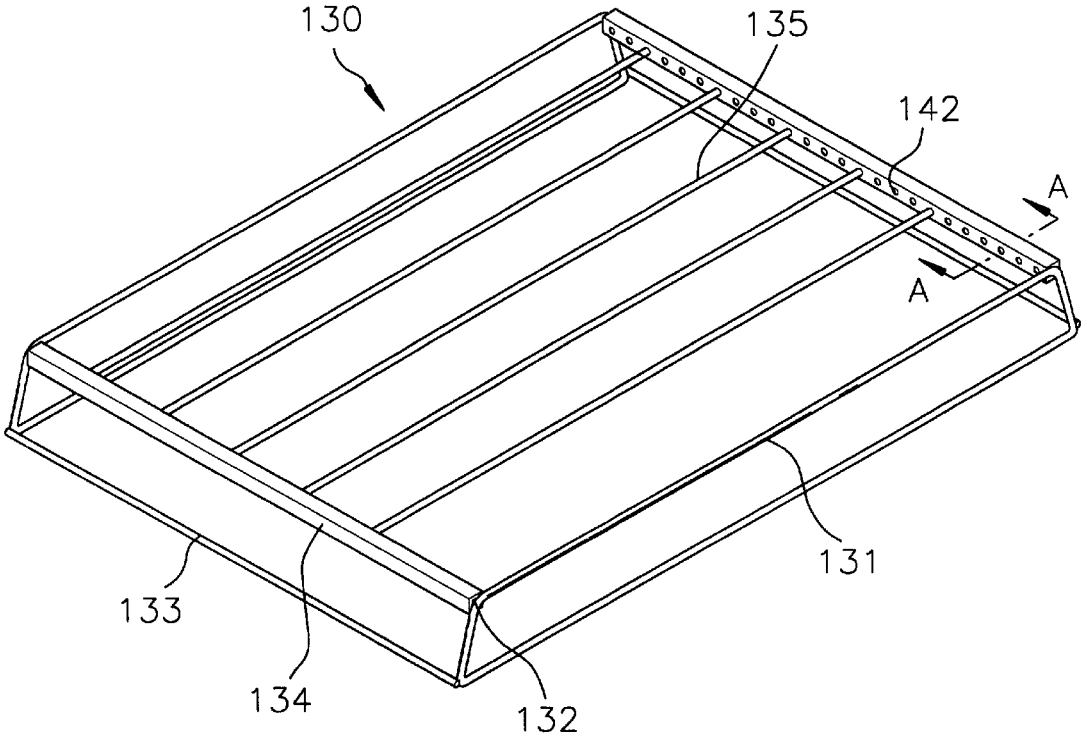
FIG. 2 presents a perspective view of an upper shelf member of a gravity feed shelf in accordance with a first embodiment of the present invention.
Figure 3:
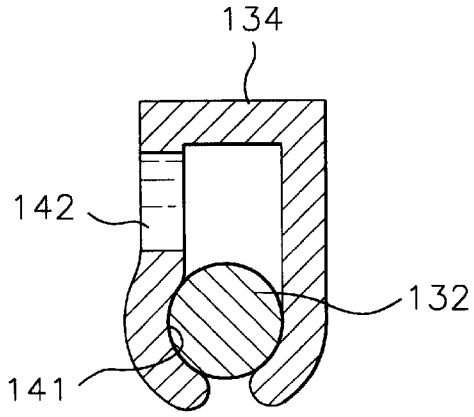
FIG. 3 depicts a cross sectional view of a guide fixing portion, taken along line A—A of FIG. 2.

Referring now to FIGS. 2 and 3, there is shown a gravity feed shelf in accordance with a preferred embodiment of the present invention. The inventive gravity feed shelf is similar to the prior art gravity feed shelf shown in FIG. 1 except for an upper shelf member 130 incorporated therein.

The upper shelf member 130 includes a pair of side frames 131, a pair of cross bars 132 fixed on an upper portion of the side frames 131, respectively, a pair of junction bars 133 fixed on a lower portion of the side frames 131, respectively, a pair of guide fixing members 134, each being disposed on the cross bars 132, and a plurality of guide rails 135.

The side frames 131 prevent containers from falling through the sides of the shelf and the cross bars 132 prevent the containers from falling off the shelf. Further, the junction bars 133 are used to attach the upper shelf member 130 onto the shelf supporting member 10(FIG. 1).

Each of the guide fixing member 134, as shown in FIG. 2, has an inverted U-shaped configuration and includes a bent portion 141 on both ends to allow the cross bar 132 to be inserted thereinto and maintained thereon and a plurality of regularly spaced apart guide fixing holes 142 on a side thereof. It is preferred that an inner diameter of the bent portion 141 may be determined depending on an outer diameter of the cross bars 132 and the distance between the neighboring guide fixing holes 142 may be set by based on the width or diameter of the containers such as cans or bottles to be accommodated. A preferred range of the distance between the guide fixing holes 142 is 5 to 15 mm.

Both ends of each of the guide rails 135 are inserted into the guide fixing holes 142 of the guide fixing members 140 according to a need, the need being determined by the width of the containers to be accommodated. In other words, the presence of the guide fixing holes allows the distance between the guide rails to be adjusted, allowing differently sized containers to be accommodated by the shelf, thereby improving a storage efficiency thereof.

Figure 4:
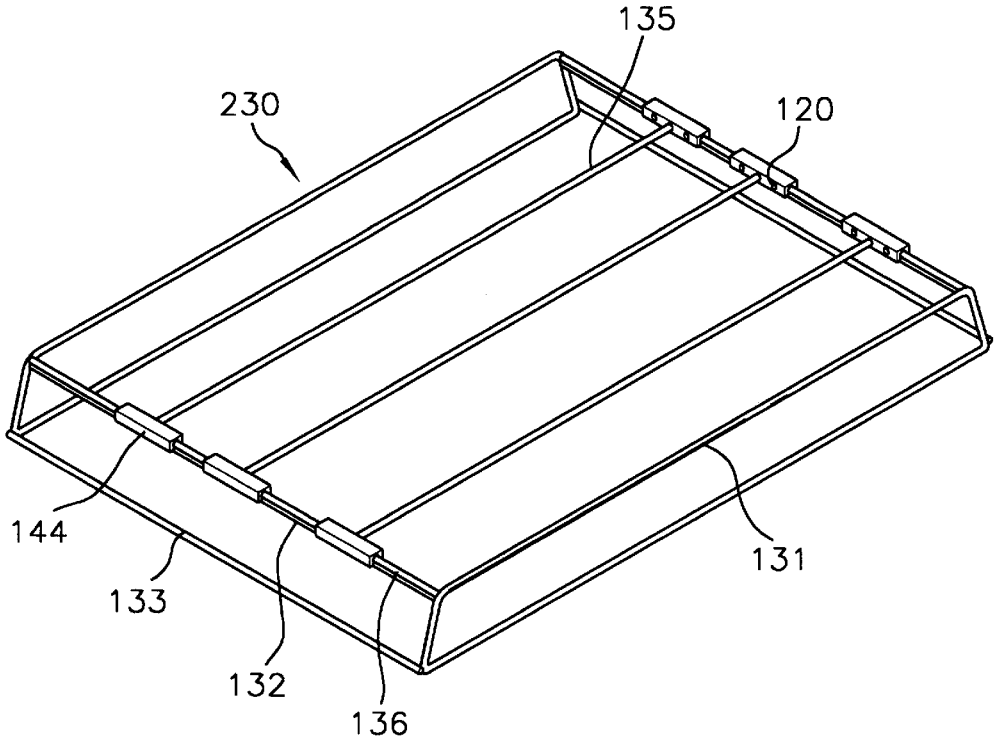
FIG. 4 offers a perspective view of an upper shelf member of a gravity feed shelf in accordance with a variation of the first embodiment of the present invention.
Figure 5:
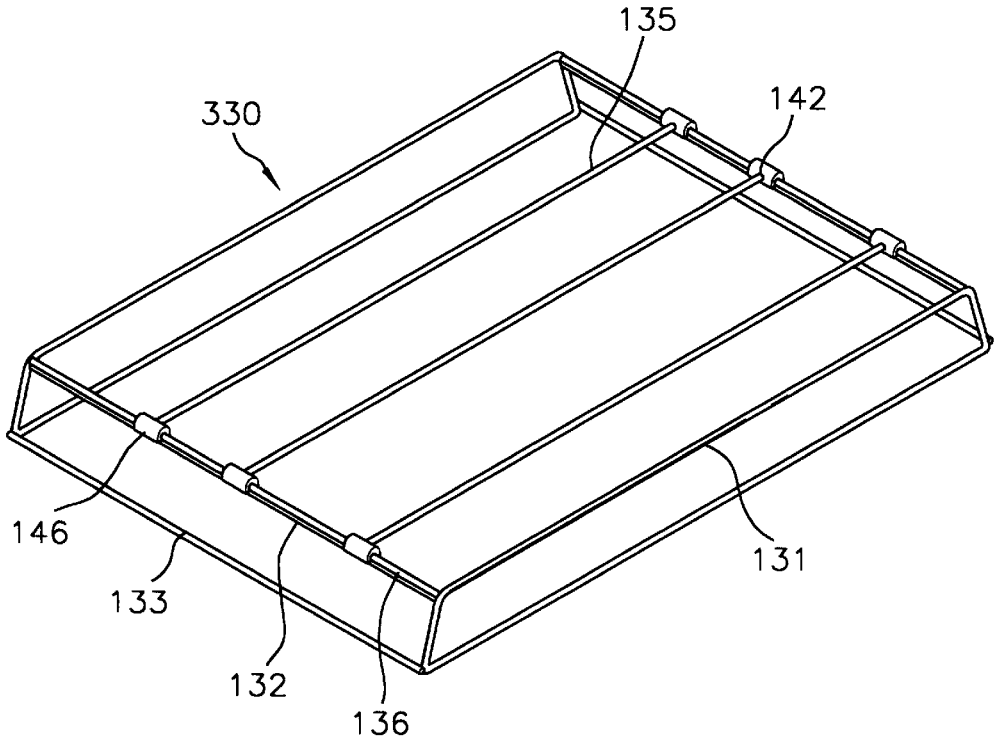
FIG. 5 illustrates a perspective view of an upper shelf member of a gravity feed shelf in accordance with a further variation of the first embodiment of the present invention.

There is shown in FIGS. 4 and 5 an upper shelf member of the gravity feed shelf in accordance with variations of the above-described embodiment, respectively.

An upper shelf member 130 in FIG. 4 is similar to the upper shelf member 130 as described above with exception of the use of a pair of rails 136 which are disposed on an upper portion of the cross bars 132, respectively, and at least a pair of guide fixing members 144 sliding along the rails 136, each of the guide fixing members 144 being provided with a plurality of guide fixing holes 142, while an upper shelf member 330 in FIG. 5 is similar to the upper shelf member 230 as described above with exception of the use of at least a pair of guide fixing portions 146, the guide fixing portions 146 in each [pair being] pair being provided with a guide fixing hole and facing each other so as to allow each end of the guide rail 135 to be inserted into the guide fixing hole 142, respectively.

Figure 6:
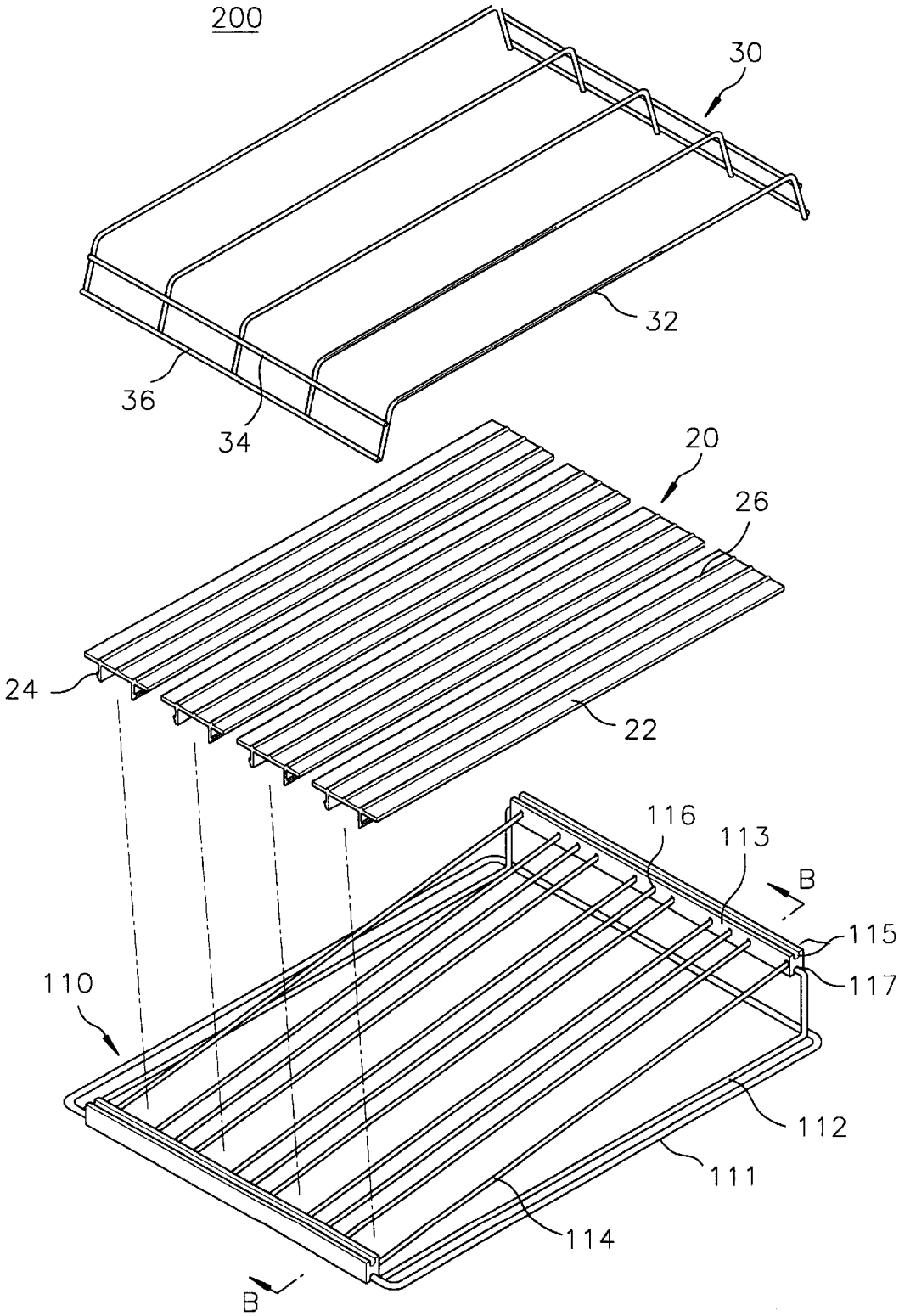
FIG. 6 represents an exploded perspective view of a gravity feed shelf in accordance with a second embodiment of the present invention.
Figure 7:
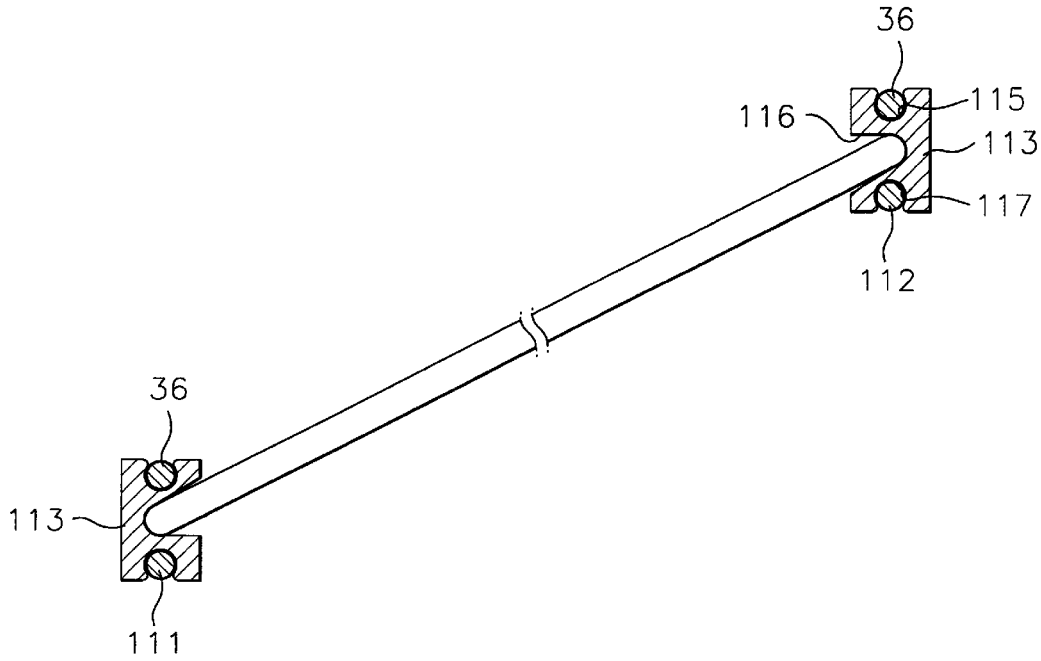
FIGS. 7 and 8 set forth views of a guide bar inserted into a groove of a fixing portion showing a condition wherein a L-shaped frame is selectively disposed or removed to and/or from a shelf supporting member, respectively, taken along line B—B of FIG. 5.
Figure 8:
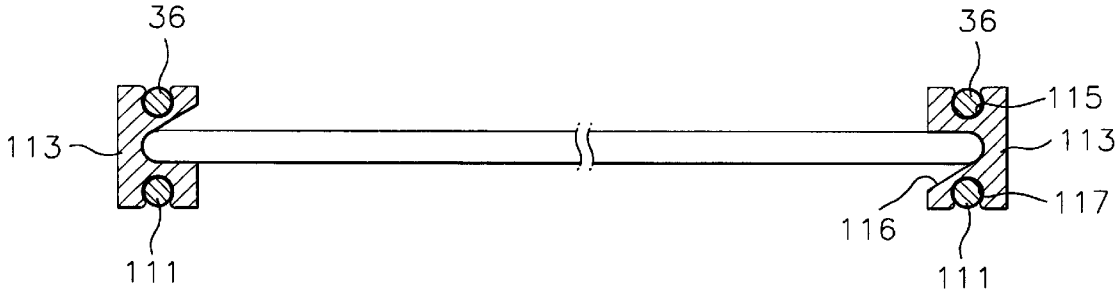

Referring to FIGS. 6 to 8, there is shown a gravity feed shelf in accordance with a second embodiment of the present invention. As shown, the gravity feed shelf 200 of this embodiment is similar to the prior art gravity feed shelf of FIG. 1 except for a shelf supporting member, the shelf supporting member allowing the shelf to be installed in a refrigerator unit or a display stand provided with horizontal inner hangers. Accordingly, the upper and the lower shelf members 30 and 20 of the gravity feed shelf depicted in FIG. 1 will not be further discussed herein for the purpose of avoiding redundant description thereof. Rather, the following discussions are primarily directed to the shelf supporting member of the present invention with reference to FIGS. 6 to 8.

As illustrated in FIG. 6, the shelf supporting member 110 includes a rectangular frame 111 to be mounted on a horizontal inner hanger (not shown), a pair of L-shaped frames 112 mounted on the rectangular frame 111 for sloping the lower shelf member 20, a pair of fixing members 113, and a plurality of longitudinal supporting rails 114 for supporting the lower shelf member 20. Each of the fixing members 113 is provided with an upper groove 115 into which the junction bar 36 of the upper shelf member 130 is inserted, a plurality of rail holes 116 into which the rails 114 are inserted, respectively, and a lower groove 117 into which the frame 111 or the L-shaped frame 112 is inserted depending on the user's requirement.

When the inventive gravity feed shelf is to be installed in a refrigerator unit or display stand provided with horizontal inner hangers, the L-shaped frame 112 is disposed to the frame 111 of the shelf supporting member 110 to be inserted into the lower groove 117 of the rear fixing member 113. However, when the inventive gravity feed shelf is to be installed in a refrigerator unit or display stand provided with inner hangers inclined from back to front, the L-shaped frame 112 can be removed from the frame 111 of the shelf supporting member 110 which is inserted into the lower groove 117 of the rear fixing member 113.

As shown in FIGS. 7 and 8, the rails 114 can be horizontally or inclinedly inserted into the rail holes 116, respectively, by selectively employing the L-shaped frame 112. If the slope of the rails 114 is inconsistent with the configuration of the rail holes 116, the rails 114 my be bent. Accordingly, in order to prevent the above from happening, the rail hole of the front fixing member 113 and that of the rear fixing member 113 are upwardly and downwardly opened, respectively.

To summarize, the presence of the L-shaped frame in this embodiment allows the possible usage of the gravity feed shelf be expanded in refrigerators or displays. For example, in a refrigerator unit or a display stand having horizontal inner hangers, the presence of the L-shaped frame allows the shelf to function as a gravity feed shelf and in a refrigerator unit or display stand having inclined inner hangers, by removing the L-shaped frame therefrom, it becomes a conventional gravity feed shelf as in the first embodiment.

Figure 9:
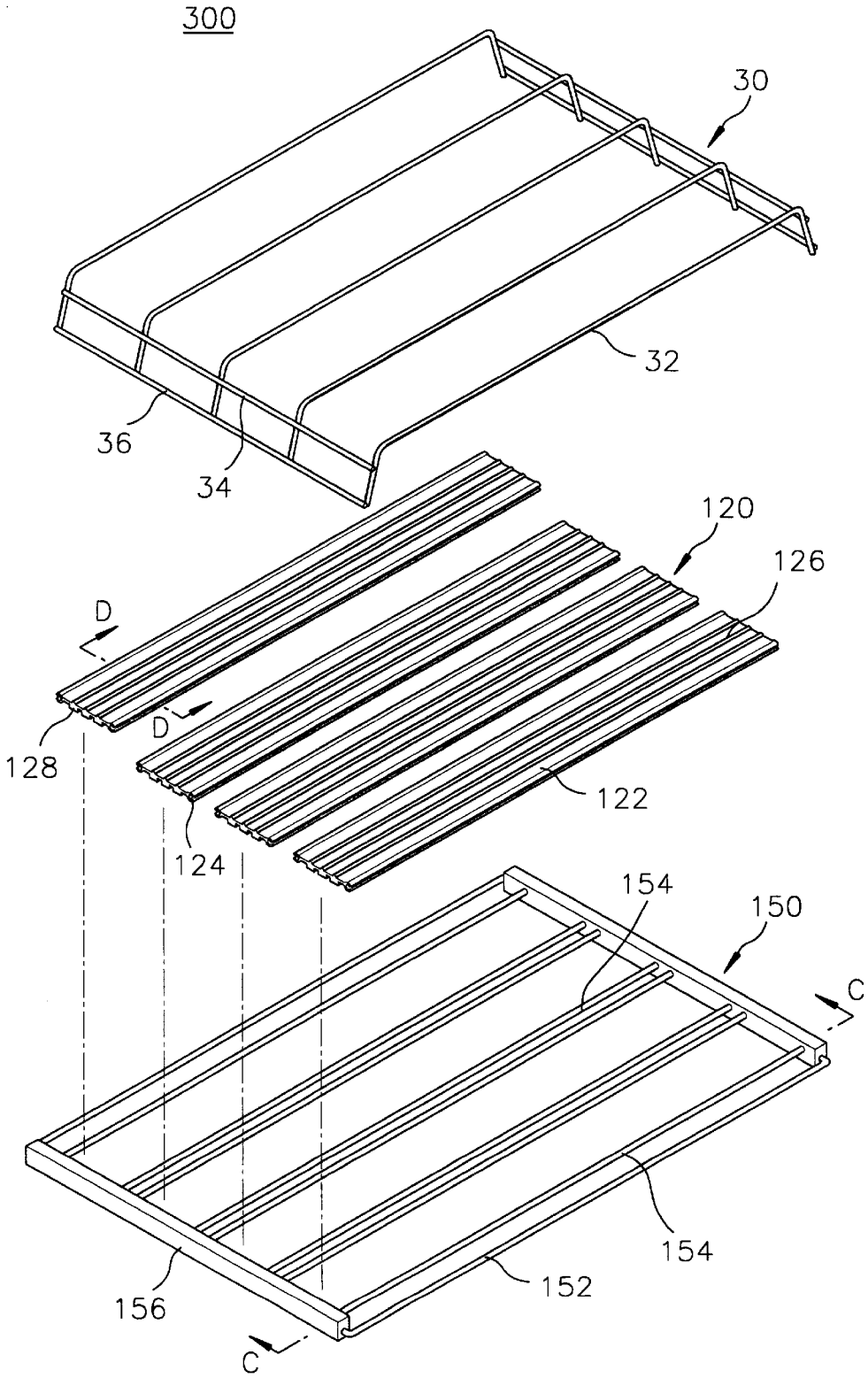
FIG. 9 describes an exploded perspective view of a gravity feed shelf in accordance with a third embodiment of the present invention.
Figure 10:
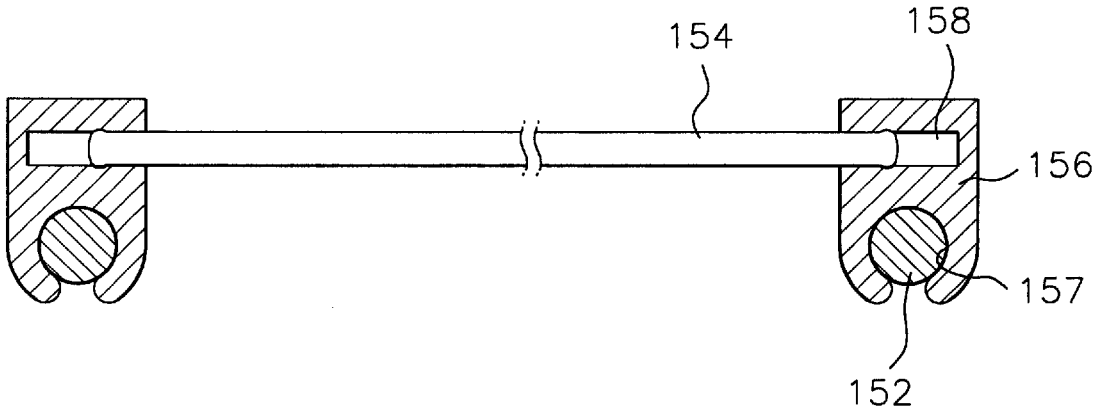
FIG. 10 provides a cross-sectional view of a shelf supporting member, taken along line C—C of FIG. 9.
Figure 11:
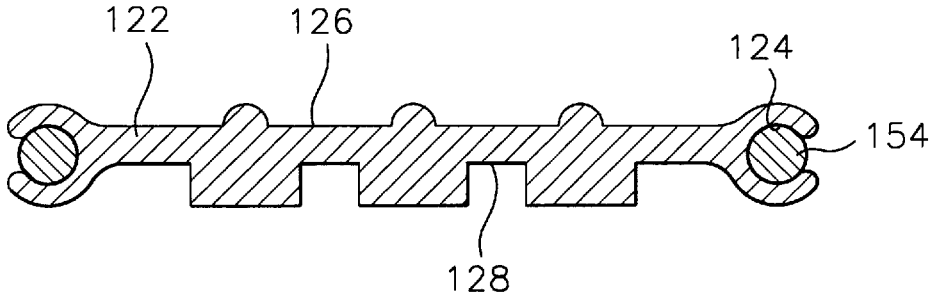
FIG. 11 indicates a cross-sectional view of a lower shelf member, taken along line D—D of FIG. 9.

Referring now to FIGS. 9 to 11, there is shown a gravity feed shelf in accordance with a third embodiment of the present invention. As shown, the gravity feed shelf 300 of this embodiment is similar to that of the prior art gravity feed shelf as shown in FIG. 1 with exception of a shelf supporting member 150 and a lower shelf member 120.

The inventive shelf supporting member 150 includes a rectangular frame 152, a pair of fixing members 156, each being mounted on a front portion and a rear portion of the frame 152, and a plurality of longitudinal supporting rails 154 insertably fixed in the fixing members 156 by welding on the frame 152. The frame 152 is supported by a suspension(not shown) fixed on an inner rear surface and inner hangers(not shown) formed on inner lateral surfaces of a refrigerator unit or a display stand.

As best shown in FIG. 10, the fixing members 156 are provided with a U-shaped groove 157 for allowing the rectangular frame 152 to be inserted thereinto and a horizontal groove 158 opened inward so as to allow the longitudinal supporting rails 154 to be inserted thereinto, respectively, allowing the fixing members 156 to be mounted on the rectangular frame 152 by the U-shaped groove 157 and the supporting rails 154 inserted into the horizontal groove 158 to be mounted on the rectangular frame 152 through the fixing members 156. Further, the supporting rail 154 may be separated from the horizontal grooves 158 of each of the fixing members 156, by being selectively inserted into the horizontal grooves 158.

On the other hand, the lower shelf member 120 includes a pair of U-shaped channels 124 having a laterally opened groove so as to allow the supporting rails 154 of the shelf supporting member 150 to be inserted thereinto and a plurality of plane members 122. Each of the plane members 122 includes a first surface 126 having a plurality of semicircular or triangular projections with a view to reducing the contact area between the lower shelf member 120 and containers and a second surface 128 having a plurality of rectangular projections with a view to increasing the contact area therebetween. Either the first or the second surface 126 or 128 may be selected depending on the weight of the containers to be stored. When the containers are light weighted, the first surface 126 may be positioned as an upper surface of the plane member 122 and vice versa. This is achieved by separating the supporting rails 154 of the shelf supporting member 150 inserted into the U-shaped channel 124 from the laterally opened horizontal grooves 158 of the fixing members 156, turning them over and reinserting them into the laterally opened horizontal grooves 158. Further, in order to prevent the U-shaped channel 124 from interrupting the sliding of the containers, it is preferred that, as shown in FIG. 11, the height of an upper and a lower portion of the U-shaped channel 124 may be within that of the projections of each of the first and the second surfaces 126 and 128.

Although the invention has been shown and described with respect to the preferred embodiments, it will be understood by those skilled in the art that certain changes and modifications may be made without departing from the spirit and scope of the invention as defined in the following claims.

What is claimed is:

1. A gravity feed shelf for use in a refrigerator unit or a display stand, said gravity feed shelf comprising:

a shelf supporting member including a rectangular frame, a pair of fixing members, and a plurality of longitudinal supporting rails;

a plurality of lower shelf members including a plurality of overlays each having a pair of longitudinal fingers and thin longitudinal ribs formed on an upper surface of the overlays so as to reduce a friction between containers and the overlays, respectively; and an upper shelf member including a plurality of guide rails for preventing the containers from falling through both sides of the shelf, the guide rails being held by said pair of fixing members, a pair of cross bars for preventing the containers from falling off the shelf, and a pair of junction bars for fixing the guide rails on the shelf supporting member.

2. The gravity feed shelf according to claim 1, wherein each of the fixing members is provided with an upper groove into which the junction bar of the upper shelf member is inserted, a plurality of rail holes into which the rails are inserted, respectively, and a lower groove into which the frame is inserted.

3. The gravity feed shelf according to claim 2, wherein the shelf supporting member further includes a pair of L-shaped frames selectively mounted on the rectangular frame to be inserted into the lower groove of a rear fixing member.

4. The gravity feed shelf according to claim 3, wherein the rail hole of a front fixing member is upwardly opened and the rail hole of the rear fixing member is downwardly opened.

5. A gravity feed shelf for use in a refrigerator unit or a display stand, said gravity feed shelf comprising:

a shelf supporting member including a rectangular frame, a pair of fixing members, each being mounted on a front portion and a rear portion of the frame, and a plurality of longitudinal supporting rails insertably fixed on the fixing members;

a set of lower shelf members removably mounted on said shelf supporting member, each said lower shelf member including a pair of U-shaped channels each having a laterally opened groove so as to allow a supporting rail of the shelf supporting member to be inserted thereinto and a plane member having a first surface with a plurality of projections extending therefrom and a second surface with a plurality of projections extending therefrom, the projections of the second surface being larger than those of the first surface and the projections extending from the first surface having a shape different from those of the projections extending from the second surface; and an upper shelf member to be mounted on said shelf supporting member, said upper shelf member including a plurality of guide rails for preventing containers from falling through both sides of the shelf, a pair of cross bars for preventing the containers from falling off the shelf, and a pair of junction bars for fixing the guide rails on the shelf supporting member.

6. The gravity feed shelf according to claim 5, wherein each of the fixing members of the shelf supporting member includes a U-shaped groove for allowing the rectangular frame to be inserted thereinto and a horizontal groove opened inward so as to allow the longitudinal supporting rails to be inserted thereinto.

7. The gravity feed shelf according to claim 5, wherein the projections of the first surface are semi-circular and the projections of the second surface are rectangular.

* * * * *